United States Patent [19]

Omar

[11] Patent Number: 4,469,141

[45] Date of Patent: Sep. 4, 1984

[54] DOUBLE LIFT DOBBY

[75] Inventor: Abdul W. Omar, Lahore, Pakistan

[73] Assignee: Pakistan Council of Scientific and Industrial Research, Karachi, Pakistan

[21] Appl. No.: 421,870

[22] Filed: Sep. 23, 1982

[30] Foreign Application Priority Data

Sep. 30, 1981 [GB] United Kingdom ..... 8129577
Dec. 14, 1981 [GB] United Kingdom ..... 8137627

[51] Int. Cl.[3] ..... D03C 1/06
[52] U.S. Cl. ..... 139/71
[58] Field of Search ..... 139/66–74

[56] References Cited

U.S. PATENT DOCUMENTS 1,122,650 12/1914 Shayer ..... 139/72
1,177,343 3/1916 Levy ..... 139/68

FOREIGN PATENT DOCUMENTS 855524 11/1952 Fed. Rep. of Germany ..... 139/71
370025 7/1963 Switzerland ..... 139/72
1085320 9/1967 United Kingdom ..... 139/66 R

*Primary Examiner*—James Kee Chi
*Attorney, Agent, or Firm*—Jeffers, Irish & Hoffman

[57] ABSTRACT

A reciprocating double lift dobby operating an open shed has a pair of drive members 1, 2 which reciprocate at half the loom frequency and 180 degrees out of phase, one above and the other below a series of shafts 3 which are connected one to each of the loom harnesses and each of which is movable by either drive member between a pair of stationary positions, corresponding to the base positions of the open shed, when required to do so by the weave pattern. One of the stationary positions is defined by a fixed member 5 engaging a stop 15 on the shaft 3, and the other is defined by a catch 8 which engages a lug 18 on the shaft. In each loom cycle, each shaft 3 will either remain in one or other of the stationary positions or will be moved from one to the other depending on the positions adopted by linked selection levers 9, 10, 20 which are controlled by the weave pattern. If a shaft 3 is required to move, the levers 9, 10 will cause a catch 6, 7 on the first of the two drive members 1, 2 which arrives at the current stationary position of the shaft to engage a lug 16, 17 on the shaft and move the shaft to the other stationary position on the next stroke of the drive member, the lever 20 engaging or releasing the catch 8 as necessary. If a shaft 3 is not required to move, the levers 9, 10 do not act on the catches 6, 7 and the drive members 1,2 do not disturb the shaft from its stationary position.

7 Claims, 7 Drawing Figures

DOUBLE LIFT DOBBY

The invention relates to dobbies for weaving looms and more particularly to reciprocating double lift dobbies operating with open shed action.

The operation of dobby looms consists of a series of loom cycles in each of which the warp threads are selectively shed and a pick of weft is laid across in the shed opening. A different pattern of warp is then shed and a different pick is inserted. The procedure is repeated from cycle to cycle until the cloth is woven in accordance with a predetermined pattern or programme of the weave. Warp threads which always shed identically form a single group and are moved by a harness, and in order to weave complex patterns a large number of harnesses are required and, occasionally, many different supplies of weft as well. These are controlled by a mechanism known as a dobby, which employs a number of selectively operated units, to each of which is assigned a warp harness or a weft supply, and a reciprocating primary drive for operating the units selectively according to a predetermined programme. The primary drive reciprocates at the full loom frequency in a single lift dobby, and at half the loom frequency in a double lift dobby.

In high speed weaving, a double lift dobby is usually the preferred choice, the main reason being that its one cycle covers two picks or two loom cycles, which enables it to cope with relatively high loom speeds. An equally important second reason is that, by using a selectively operated unit known as a a baulk mechanism, the double lift dobby has proved successful in offering a satisfactory solution to the problem of open shed action. This is a form of shedding operation in which the warp threads undergo a minimum of travel by maintaining two separate base positions from where they shed selectively, and ideally the unselected threads and their harnesses should be undisturbed at whichever base position they occupy, since such stability contributes to vibration free operation and hence to the weaving efficiency. The well known baulk mechanism, in its developed form, has met the requirements of stability satisfactorily, but it has tackled the problem of open shed action from a dynamical approach and has supplied the solution accordingly. Thus, only one base of the open shed is given a static existence, to which the selection process is also confined, and the second base is derived by averaging two opposite motions initiated by applying the selection to the first base. This dynamical approach suffers from some inherent limitations, which are briefly reviewed below, and to overcome these limitations is the main object of this invention.

Firstly, in the baulk mechanism, the motion transmitted to the threads is always an average and hence its value can never rise above 50% of the full motion that is transferred to the baulk by the primary drive. To compensate for the 50% loss of the primary motion, either a large leverage or a second stage amplification is added, either of which options greatly increases the inertial mass and the bulk of the machine. Secondly, the base position which is derived by averaging two opposite motions, may not consistently give a zero average, and thus stands as a source of instability and vibrations. Thirdly, since the open shed action is essentially a function of two opposite motions, it suffers from wear and inertia of the baulk assembly and imposes an additional load on the primary drive. The resulting energy loss becomes very prominent when the loom speed is raised.

A different open shed technique, free of the averaging action of the baulk mechanism, is also known and is used for instance in some double lift jacquards. It employs, as a typical jacquard approach, selectively operated units made of flexible hooks, which are too fragile to be used in dobbies. The technique, moreover, is again not capable of yielding a stable operation, since the hooks at the top position of the open shed are continually being struck by the griffe. This form of interference is a common problem in those odd dobbies as well where an indirect operation of selection is applied, for example in some single lift open shed dobbies previously devised by the present inventor.

According to the present invention, a reciprocating double lift dobby operating with open shed action comprises a primary drive of two drive members reciprocating at half the loom frequency, and a series of selectively operated rigid shafts which are connected one to each of the loom harnesses and can be held stationary at two base positions, to maintain an open shed, or can be shed from there selectively by the two drive members which, with intrinsic means of selection actuated on each stroke, obtain a direct selection of the shafts from both the base positions and, through the particularly selected shafts, each drive member transmits its full motion to shed the related harnesses, while the unselected shafts, which maintain their base positions, do not come into contact with the drive members, hence providing an open shed which is static and puts no load on the primary drive.

The means of selection in each driving member which is actuated on each stroke is preferably actuated by a selection mechanism controlled by a programmed tape which advances one step each loom cycle and feeds the weave pattern in terms of holes and blanks in a known manner.

The main advantages of the dobby in accordance with the invention are summarised as follows:

1. The dobby reciprocates at half the loom frequency and, through the selectively driven rigid shafts, can transmit the full motion of its drive to the harnesses that are shed.

2. The dobby maintains a perfect stability of the harnesses in the open shed state, by providing two static base positions from where the harnesses are directly selected and shed and by avoiding interference of the drive members with the non-selected harnesses.

3. The dobby obtains the open shed action by a mechanism of static control, claiming neither inertia nor any consumption of energy.

4. The dobby introduces a self-selecting drive mechanism in double lift dobbies, thereby gaining a stable operation and an economy in the interia mass and the bulk of the machine.

An example of a dobby in accordance with the present invention will now be described with reference to the accompanying drawings, in which.

Figure 1:
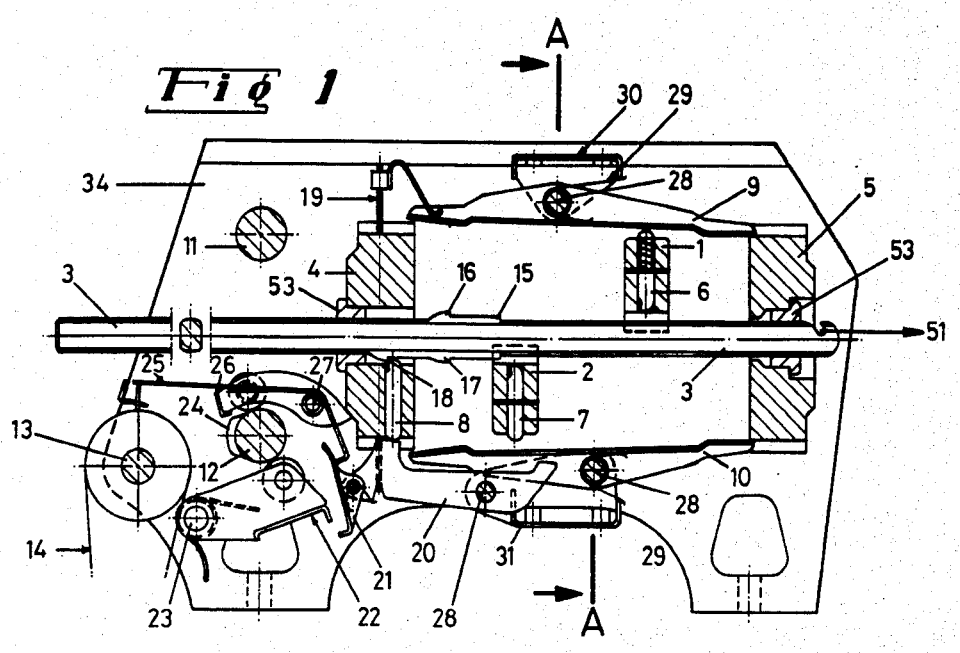
FIG. 1 is a front sectional view of the dobby, looking towards the left and taken on the line BB in FIG. 3, which omits for the sake of clarity some of the drive mechanism.
Figure 2:
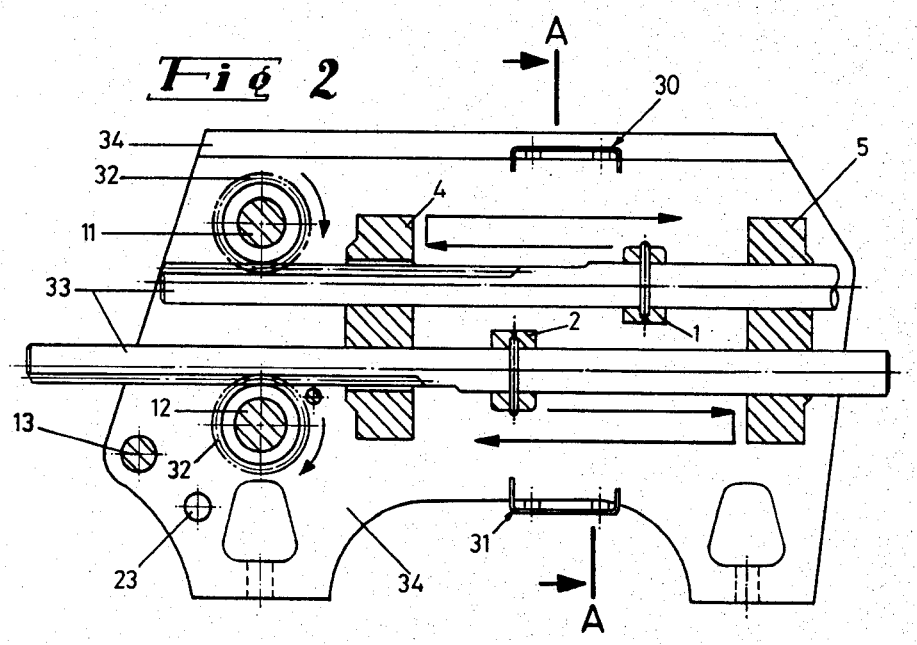
FIG. 2 is a view similar to that of FIG. 1, again looking towards the left but taken on the line CC in FIG. 3, and showing the details of the drive mechanism omitted from FIG. 1.
Figure 3:
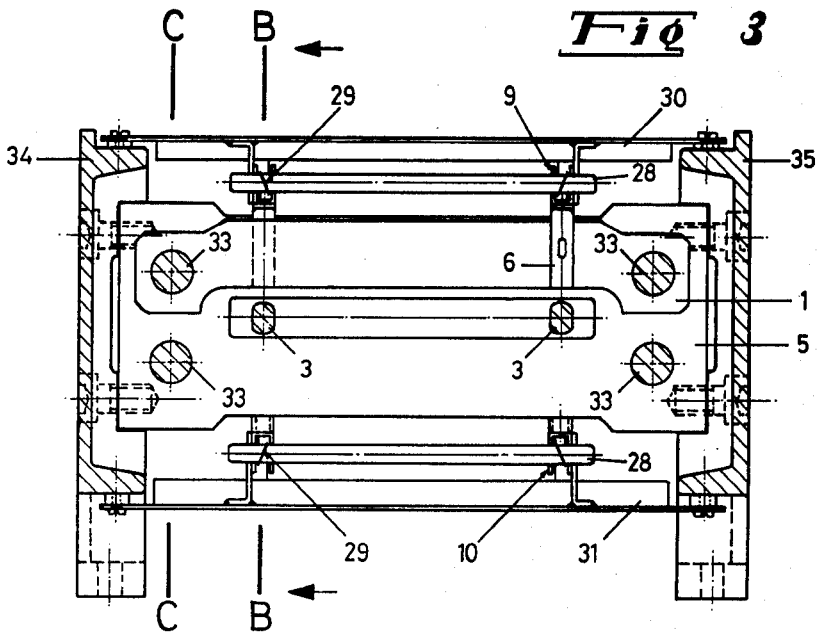
FIG. 3 is a side sectional view of the dobby, looking towards the right and taken on the line AA in FIGS. 1 and 2.

Referring first to FIGS. 1, 2 and 3 of the drawings, a pair of drive members 1 and 2 are arranged to be reciprocated at half the loom frequency, being mounted and locked each on a pair of rack bars 33 which are coupled with corresponding gears 32 integrally mounted on oscillating drive shafts 11 and 12. The arrangement is such that the drive shafts 11 and 12 both move in the same direction, covering nearly one full rotation on each oscillation and hence making the drive members 1 and 2 operate out-of-phase on the paths of reciprocation indicated in FIG. 2. Between the two drive members are located in a horizontal plane a number of linear rigid shafts 3 which are slidable in two bearing blocks 53 secured in fixed cross frames 4 and 5. In FIG. 3 only two shafts 3 are shown, but a whole set is arranged between the two on a pitch distance determined by convention. The shafts are given flattened sides or an oval cross section to give them strength even for a narrow pitch. The left extreme position of each shaft 3 is shown in FIG. 1, and the right extreme position is attained when the step 15 on the shaft comes to rest against the cross frame 5. In the position shown in FIG. 1, the distance between the step 15 and the inner face of cross frame 5 gives the motion transmitted by the shaft 3, which is practically equal to the distance covered by each drive member 1, 2 on each stroke.

Corresponding to each shaft 3, catch bolts 6 and 7 are carried by the drive members 1 and 2, and a further catch bolt 8 is located in the cross frame 4. Of these bolts, the upper bolt 6 is necessarily spring loaded but the lower bolts 7 and 8 may also function under gravity at low operating speeds. The object is to keep the bolts 6, 7 and 8 clear of the shaft unless they are pressed inwards, whereupon they may engage the shaft 3 at the respective catch points 16, 17 and 18 which form a solid part of the shaft. This inward pressure is applied selectively by three pivoted levers 9, 10 and 20 of a selection mechanism. The three levers are interlinked by a link needle 19, are pivoted on three separate identical rods 28, and are spring loaded by fork springs 29. It is to be noticed that in the set up of the selection levers shown in FIG. 1, which is the normal position under the spring action, the levers 9 and 10 diverge on the left and converge on the right, while the lever 20 presses against the bolt 8 to engage the catch point 18. In this position of the selection levers 9, 10 and 20, the shaft 3 will be held at the left, corresponding to the upper position of its connection harness (FIG. 6 or 7) which pulls in the direction of the arrow 51. Moreover, the operation of the drive members 1 and 2 will not disturb the shaft 3 because the relevant catch bolts 6 and 7 will not contact the corresponding points 16 and 17 of the shaft while the levers 9 and 10 are diverging to the left.

It will be understood later that the position of the selection mechanism given in FIG. 1 corresponds to a blank on a programmed tape 14. Moreover, had the shaft 3 been previously at its right extremity, i.e. with the step 15 against the cross frame 5, this same position of the selection levers 9 and 10 would have enabled the catch bolt 6 or 7 to engage with the respective catch point 16 or 17 at the end of the stroke of the respective member 1 or 2, and the shaft would have been driven to the left to the position shown in FIG. 1 on the next stroke. The motion transmitted to the shaft, and hence to its connected loom harness 51 on the right (FIG. 6 or 7), would have been practically equal to the stroke length of the drive.

Assuming now that the shaft 3 occupies the position shown in FIG. 1 and a downward pull is applied to the hook 21, the lever 20 will then free the catch bolt 8, will transmit the pull to the lever 9 through the link 19, and will impart an opposite push to the lever 10. The result will be a reverse arrangement of the selection levers 9, 10 and 20, in which the levers 9 and 10 will converge inwards on the left and the lever 20 will not press against the bolt 8. When a drive member 1 or 2 next reaches the left extremity of its stroke, its catch bolt 6 or 7 is pressed by the corresponding lever 9 or 10 to engage the catch point 16 or 17, and the selected shaft 3, as it is moved slightly forward, will release the bolt 8 from engagement with the shaft. The shaft 3 is then brought to the right on the next stroke of the engaged drive member till the step 15 comes to rest against the cross frame 5. The motion transmitted by the shaft 3 will again be practically equal to the full stroke length. Once this right hand position is achieved the shaft 3 will not be disturbed as long as the hook 21 always receives a down pull towards the end of each stroke of reciprocation. It will be seen that this down pull is arranged to be imparted by a pivoted cross blade 22, operated by a pair of cams 24 on the oscillating shaft 12.

The cross blade 22 is welded between two triangular arms which are pivoted on studs 23 and are spring loaded to keep the blade up in contact with the oscillating shaft 12. At this contact place the pair of cams 24 project from the shaft 12, close to the inner sides of gears 32. At the conclusion of each round of oscillation, the cams 24 throw the blade 22 downwards, but whether a hook 21 is engaged and pulled down by the blade depends on the position of an associated feeler 25. If there is a blank on the pattern tape 14, as is the case in FIG. 1, the feeler will keep the hook 21 free of the blade. On the other hand, if the feeler 25 finds a hole in the pattern tape, its end pin will sink in the hole and the hook 21, being spring loaded, will move into position for engagement by the blade. Thus the previously referred reverse arrangement of the selection levers 9, 10, 20 will be obtained. The full set of feeler levers 25 is pivoted on a cross rod 27, and on this same pivot, on the outer sides of the feelers, are carried two side arms of a feeler blade 26. The function of this blade is to lift all the feelers 25 before the pattern tape 14 is moved. This prior lifting of the feelers is a pre-requisite for the operation of a punched tape. The details of this operation are shown in FIG. 4, but it should be noted that the same cams 24 which operate the hook blade 22 at the end of an oscillation also operate the feeler blade 26 in the middle of the oscillation.

The dobby is provided with side frames 34 and 35, and on the top of these frames is mounted a cross bracket 30, which carries the assembly of the selection levers 9. Similarly, on the under side of the side frames is mounted a second cross bracket 31, which carries the assembly of the selection levers 10 and 20. These assemblies can be seen in FIGS. 1, 2 and 3.

Figure 4:
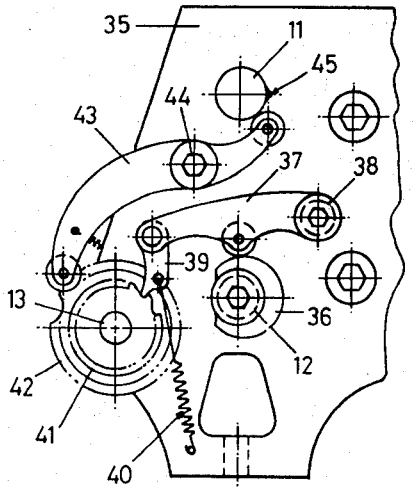
FIG. 4 is a partial front view of the dobby showing the mechanism for the operation of the programmed tape.

FIG. 4 shows the details of the selection mechanism located on the front side of the frame 35. At the protruding end of the drive shaft 12 a cam 36 is fixed which has a depression orientated in the line of the cams 24. In the middle of a stroke, the depression occupies the top position and thus allows a ratchet lever 37, pivoted on a stud 38, and a ratchet 39 to operate under the action of a spring 40 to move a rachet wheel 41 fixed on a shaft 13. Before this happens however, the feelers 25 will have been lifted by the cams 24. Thus the pattern shaft 13 is free to rotate just one step and is then again indexed by an index wheel 42 which is also fixed on the shaft 13 and which cooperates with an index lever 43 pivoted on a stud 44. A pin head 45 on the drive shaft 11 slightly lifts the lever 43 just at the right moment to facilitate the movement of the index wheel. Consequently, the pattern shaft 13 and hence the tape 14 move one step forward to present a fresh programme of blanks and holes to the feelers 25. At the end of the stroke, the drive members 1 and 2 from their two extreme positions operate the shafts 3 according to the new programme now presented.

Figure 5:
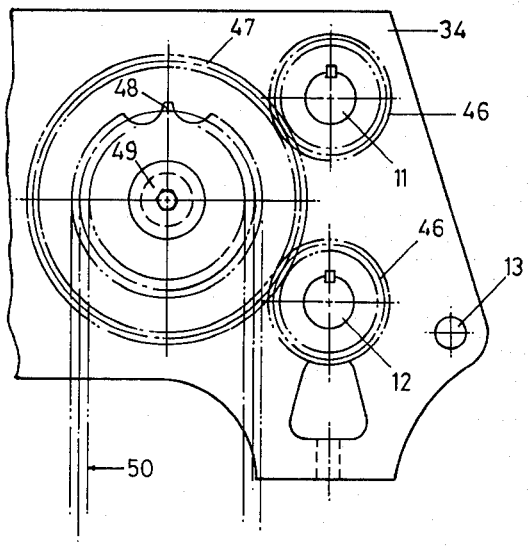
FIG. 5 is a partial back view of the dobby showing the gear arrangement at the back.

FIG. 5 shows the drive mechanism for the oscillating drive shafts 11 and 12 located on the back side of the frame 34. Each shaft 11 and 12 carries a drive gear 46 which is driven by a common gear 47 fixed to a chain wheel 48 and mounted on a stud 49. A chain 50 connects the chain wheel to a pair of cams on the bottom shaft of the loom 52. The timing and operation of these cams are arranged in accordance with known practice.

Figure 6:
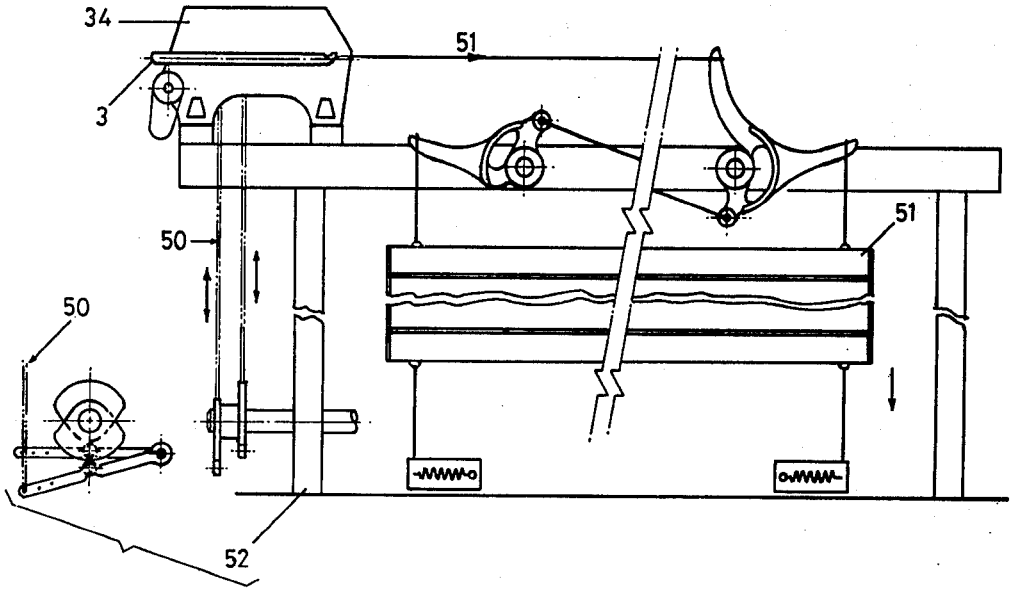
FIG. 6 is a diagrammatic front view showing one conventional arrangement of coupling a loom harness with a shaft of the dobby; and, FIG. 7 is a view similar to that of FIG. 6 but showing another conventional method of coupling a loom harness to a shaft of the dobby.
Figure 7:
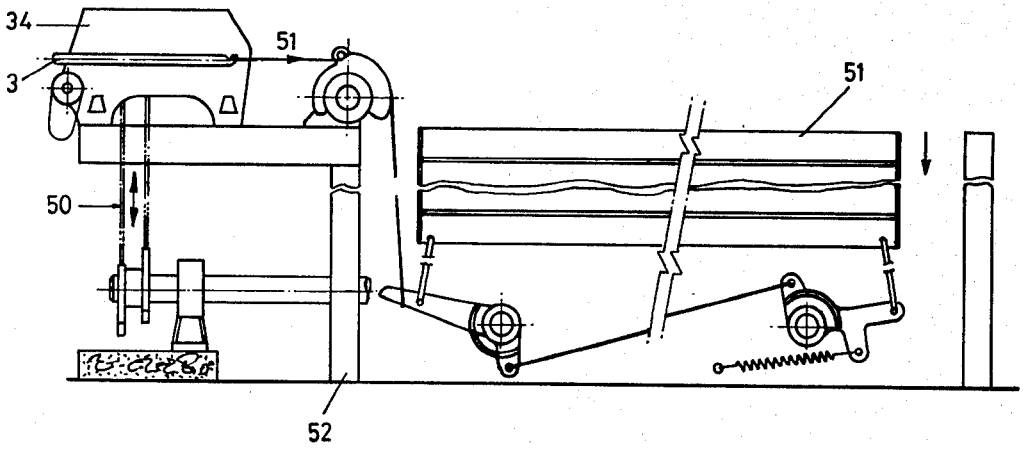

FIGS. 6 and 7 show two conventional methods of mounting the dobby on a loom frame with a negatively operated shedding motion. The harness frames 51 are arranged on the loom frame 52 with spring under motion, and the pull of the harnesses and the bottom springs keep the shafts 3 always biased to the right. An inclined shed is obtained by offering a different leverage to each harness in a known manner. In FIG. 7, however, a two-step pulley is used near the dobby, instead of a lever, in order to ensure the alignment of the shaft 3 during the operation.

It is also to be noted that the present dobby provides four independent points of selection for the drive and one for the retention of the shaft 3. Of these selection points, the selection points for the drive should be located at the ends of the reciprocating strokes, but the selection point for the retention may be located at other positions besides that shown according to variations in dobby design.

I claim:

1. A reciprocating double lift dobby for a loom operating with open shed action, said dobby comprising a primary drive including two reciprocating drive members and a drive mechanism which reciprocates said drive members 180 degrees out of phase and at half the loom frequency, a plurality of substantially rigid shafts which, in use, are connected one to each of the loom harnesses, means defining a pair of base positions for said rigid shafts and capable of holding each of said shafts stationary in either of said base positions to define said open shed, means for selectively engaging each of said shafts with either of said drive members in either of said base positions for movement therewith between said base positions, and selection means which is actuated on each stroke of said drive members to operate said engaging means to engage selectively said shafts with said drive members whereby each selected one of said shafts is moved from its current base position to the other base position with one or other of said drive members and substantially the full motion of said drive member is transmitted through said shaft to shed said loom harness connected to said shaft, while each unselected one of said shafts remain in its current base position and is not contacted nor disturbed by either of said drive members.

2. A dobby as claimed in claim 1, wherein said means defining said pair of base positions comprises a fixed stop defining a first of said base positions, said dobby being operated in association with means biassing said shafts towards said fixed stop, and a plurality of catches corresponding one to each of said shafts and defining the second of said base positions, each of said shafts being provided with a catch point which is engageable with the corresponding one of said catches, and each of said catches being selectively movable by said selection means between a position wherein said catch engages said catch point on said corresponding shaft to hold said shaft in said second base position, and a position wherein said catch is clear of said catch point on said corresponding shaft to allow said shaft to move to said first base position.

3. A dobby as claimed in claim 2, wherein each of said drive members carries a plurality of catches, one for each of said shafts, and means biassing each of said catches to an inoperative position clear of the corresponding shaft, each of said shafts being provided with a pair of catch points for said corresponding catches of said two drive members, and said selection means being capable of pushing each of said catches against its biassing means at either end of the stroke of its drive member into an operative position wherein said catch will engage the corresponding catch point on the corresponding shaft, thereby selecting said shaft, if said shaft is at the corresponding base position.

4. A dobby as claimed in claim 3, wherein said selection means includes a plurality of pivoted levers, one for each of said catches of each of said drive members, and means responsive to a selection programme for moving said pivoted levers in accordance with said programme.

5. A dobby as claimed in claim 4, wherein said selection means includes link means connecting each pair of said pivoted levers which act on the catches relating to the same shaft as each other whereby movement of one of said pair of levers produces a corresponding movement of the other of said pair.

6. A dobby as claimed in claim 5, wherein said link means of each pair of pivoted levers includes a third lever, said means responsive to said selection programme acting on said third lever, and said third lever being operable to move said catch which defines said second base position into its operative position.

7. A dobby as claimed in claim 4, wherein said selection programme is defined by a punched tape.

* * * * *